US006799623B1

(12) United States Patent
Cheng

(10) Patent No.: US 6,799,623 B1
(45) Date of Patent: Oct. 5, 2004

(54) ADHESIVE TAPE CUTTER

(75) Inventor: Wen-Shu Cheng, Taoyuan (TW)

(73) Assignee: Tai-Ray Industries Ltd., Taoyuan (TW)

( * ) Notice: Subject to any disclaimer, the term of this patent is extended or adjusted under 35 U.S.C. 154(b) by 0 days.

(21) Appl. No.: 10/460,201

(22) Filed: Jun. 13, 2003

(51) Int. Cl.[7] ..... B32V 31/00

(52) U.S. Cl. ..... 156/527; 156/523; 156/577; 156/579; 225/19; 225/20; 225/56; 225/77

(58) Field of Search ..... 156/577, 579, 156/574, 523, 527; 225/19, 20, 56, 77, 91

(56) References Cited

U.S. PATENT DOCUMENTS 5,641,377 A 6/1997 Chung et al.
2002/0195204 A1 12/2002 Huang

*Primary Examiner*—Richard Crispino
*Assistant Examiner*—Cheryl N. Hawkins
(74) *Attorney, Agent, or Firm*—Birch, Stewart, Kolasch & Birch, LLP

(57) ABSTRACT

An adhesive tape cutter includes a control mechanism, an operation mechanism located on the control mechanism and a dispensing mechanism connecting to the control mechanism and located above the operation mechanism. The control mechanism has a protective mechanism, a wiper and a cutting mechanism. When the tape cutter is not in use, the protective mechanism is extended over the cutting mechanism outside the tape cutter to avoid hurting users.

3 Claims, 5 Drawing Sheets

ADHESIVE TAPE CUTTER

FIELD OF THE INVENTION

The present invention relates to an adhesive tape cutter and particularly to an improved adhesive tape cutter that has a protective mechanism extended over a cutting mechanism outside the tape cutter to avoid hurting users.

BACKGROUND OF THE INVENTION

These days adhesive tape cutters are generally being used to seal cartons at plants. FIG. 1 illustrates a conventional adhesive tape cutter which includes a control mechanism 1', an operation mechanism 2 attached to the control mechanism 1' and a dispensing mechanism 3 connected to the control mechanism 1' and located above the operation mechanism 2. The control mechanism 1' has a wiper 5, a cutting blade 62 at the front end and a cutting blade protective cap 7 located above the cutting blade 62. The cutting blade protective cap 7 can cover the cutting blade 62 when not in use to avoid hurting users. When in use, open the protective cap 7 and apply a force on the operation mechanism 2 to roll the roller 14, the adhesive tape mounted on the dispensing mechanism 3 may be pulled out to stick to the location desired. The wiper 5 may brush the bonding tape to smooth the tape without generating air bubbles or wrinkles. When the sealing is completed, users may press the cutting blade 62 to sever the tape. Such a design requires users to open the protective cap 7 every time the tape cutter is used. However users often just dispose the tape cutter offhandedly when tape cutting task is finished and forget to close the protective cap 7. The next user could be incidentally hurt by the exposed cutting blade 62. It is inconvenient.

To remedy the problem set forth above, some improvements on the tape cutter have been proposed. U.S. Pat. No. 5,641,377 discloses a tape applicator with a retractable blade. It has a lever mechanism to extend the blade to sever the tape when an user has finished sealing and presses the tape. The lever mechanism mainly includes the blade and a wiper located in the tape applicator. When not in use, the lever mechanism is pulled by a spring located in the tape cutter to retract the blade inside the tape applicator.

U.S. patent publication No. 2002/0195204 A1 discloses another tape applicator to avoid hurting users. An elastic protective piece is provided above the blade. The elastic protective piece is a flexible element of a small thickness. When not in use, the front edge of the elastic protective piece may be bent downwards to cover the blade. When the sealing task is completed, user may depress the tape and the front edge of the elastic protective piece is tilted and deformed slightly to expose the blade to sever the tape.

In the two aforesaid examples users have to exert a force on the wiper or the elastic protective piece, a great deformation might occur and result in fractures. The damaged tape applicator becomes useless and users have to buy a new set. It is not convenient or economical.

SUMMARY OF THE INVENTION

Therefore the primary object of the invention is to resolve the aforesaid disadvantages. The adhesive tape cutter of the invention includes a protective mechanism, a wiper and a cutting mechanism that can protect users from injury when the tape cutter is not in use.

In order to achieve the foregoing object, the adhesive tape cutter of the invention includes a control mechanism, an operation mechanism located on the control mechanism and a dispensing mechanism connecting to the control mechanism and located above the operation mechanism. The control mechanism has a protective mechanism, a wiper and a cutting mechanism. When the tape cutter is not in use, the protective mechanism is extended over the cutting blade outside the tape cutter to avoid hurting users.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
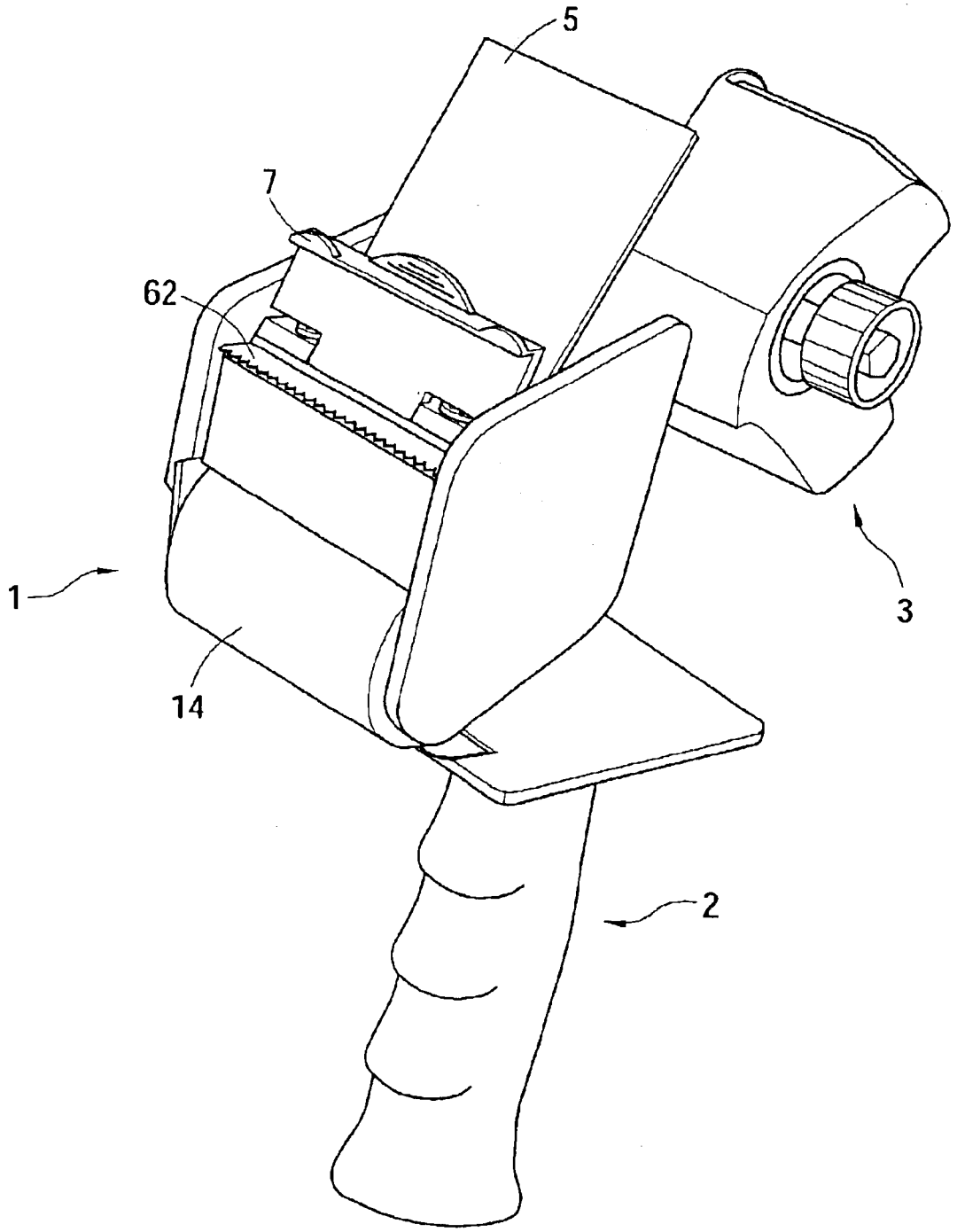
Fig.1 PRIOR ART
FIG. 1 is a perspective view of a conventional adhesive tape cutter.
Figure 2:
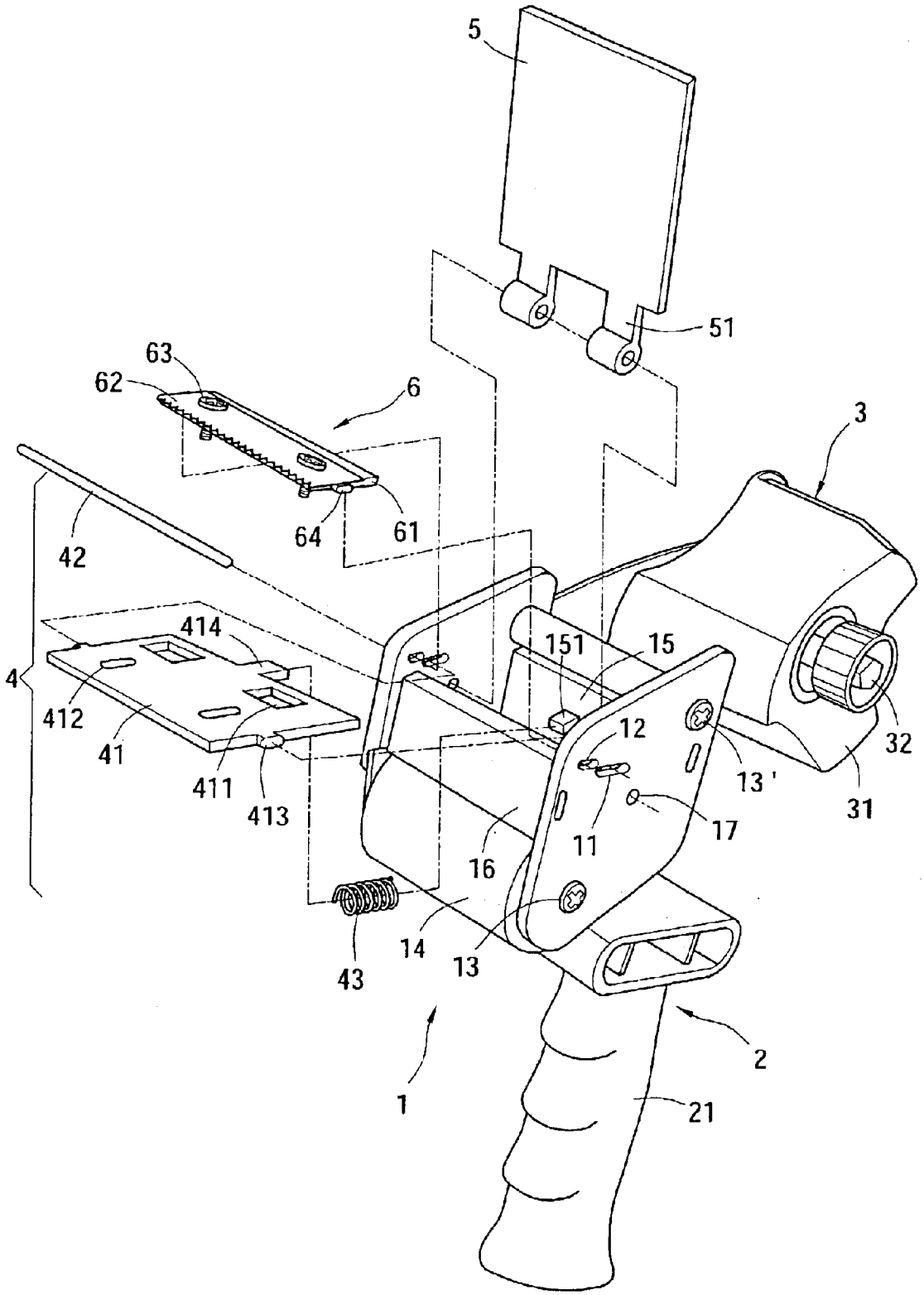
FIG. 2 is an exploded view of the present invention.
Figure 3:
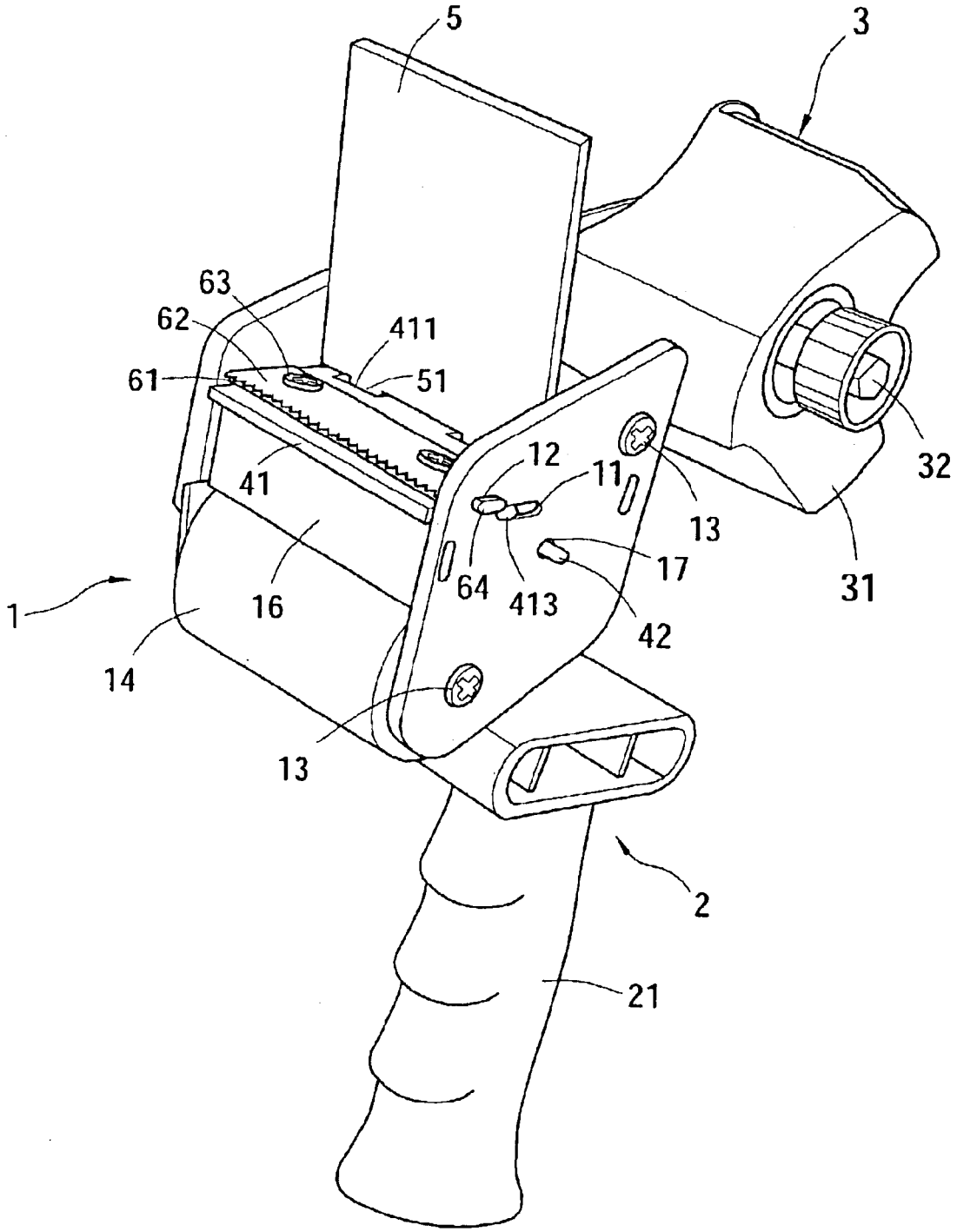
FIG. 3 is a perspective view of the present invention.
Figure 4:
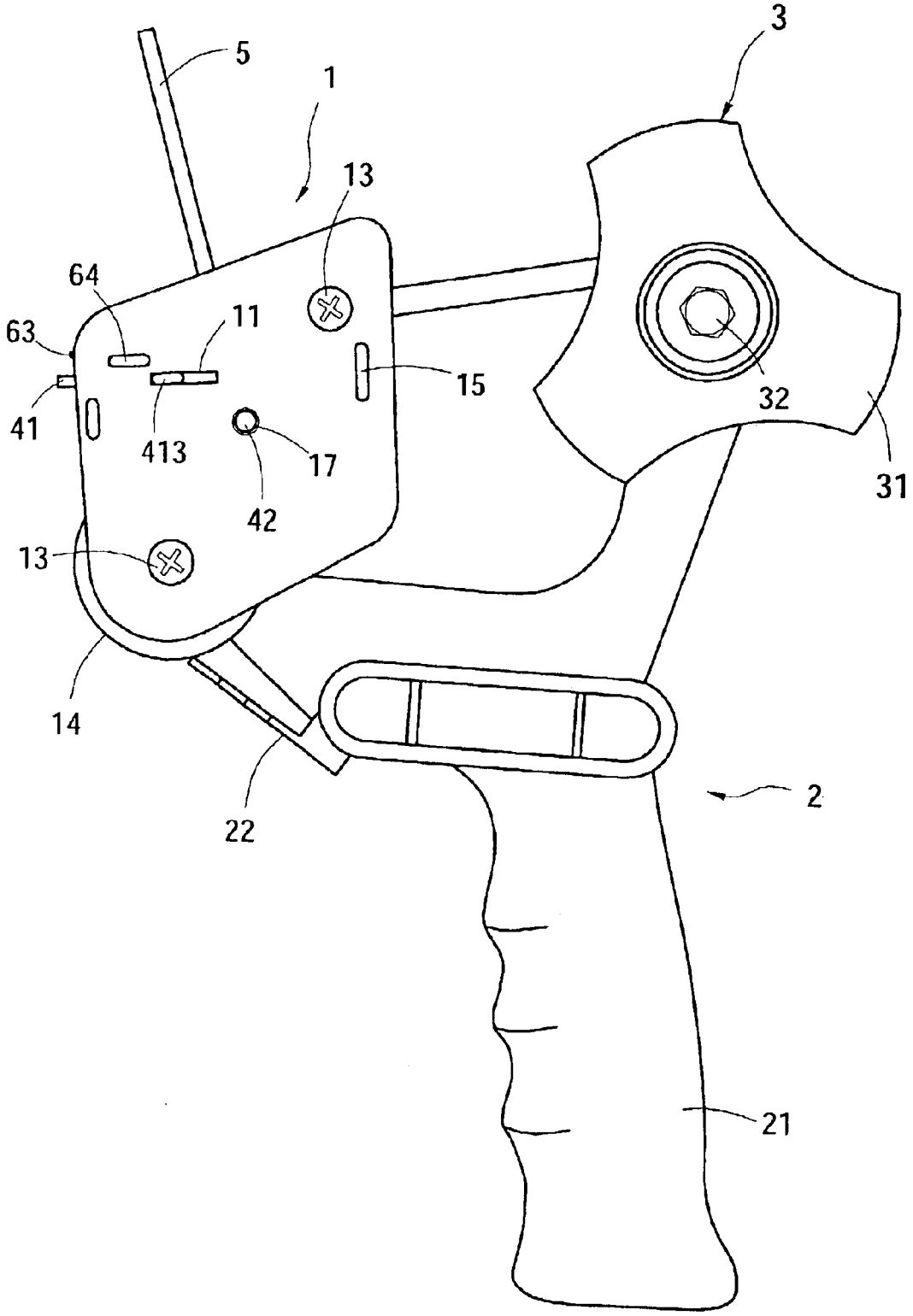
FIG. 4 is a side view of the present invention.

Please refer to FIGS. 2 through 5B, the adhesive tape cutter of the invention includes a control mechanism 1, an operation mechanism 2 located on the control mechanism 1 and a dispensing mechanism 3 connecting to the control mechanism 1 and located above the operation mechanism 2. The control mechanism 1 has a protective mechanism 4, a wiper 5 and a cutting mechanism 6. When the tape cutter is not in use, the protective mechanism 4 is extended over the cutting mechanism 6 outside the tape cutter to avoid hurting users.

The control mechanism 1 includes a protective mechanism 4, a wiper 5 and a cutting mechanism 6. The protective mechanism 4 includes a protective plate 41 which has a first operation zone 411, a second operation zone 412 and two guiding sections 413 located on two sides opposing each other. Each of the guiding sections 413 is movable in an operation slot 11 formed on the control mechanism 1. The operation slot 11 guides the moving direction of the guiding section 413. There is an axle 42 located below the protective plate 41. The axle 42 runs through a hole 17 formed on the control mechanism 1. The protective plate 41 further has a lug 414 to couple with an elastic element 43 which may be a spring or an elastic strip (preferably a spring as shown in the embodiment), The elastic element 43 has other end coupling with a stub 151 located on a back panel 15 of the control mechanism 1. The wiper 5 has a pivotal section 51 to couple with the axle 42. The pivotal section 51 runs through the first operation zone 411. The cutting mechanism 6 is located above the protective plate 41. It includes a panel 61 and a cutting blade 62 located on the panel 61. The panel 61 has two lugs 64 extending from two sides thereof to run through two apertures 12 formed on the control mechanism 1. The cutting blade 62 is fastened to the panel 61 through a fastener 63. The fastener 63 has one end extending under the panel 61 to run through the second operation zone 412 so that the fastener 63 may be moved without scrapping the protective plate 41 or hindering the movement of the protective plate 41. The control mechanism 1 further has two fasteners 13 and 13' to couple with a roller 14. There is a front panel 16 located at the front end of the control mechanism 1.

The operation mechanism 2 is fastened to a lower side of the control mechanism 1. It has a handle 21 to enable users to grasp and apply forces on the tape cutter to bond the adhesive tape. The operation mechanism 2 has a grid gate 22 at the front end thereof. The grid gate 22 has one end abutting the roller 14 of the control mechanism 1 to form a gap to allow the adhesive tape to pass through.

The dispensing mechanism 3 includes a shaft 31 for mounting a roll of adhesive tape. The shaft 31 has an adjusting element 32 which may be a screw and may be tightened or loosened to adjust the turning force of the adhesive tape and avoid rolling too fast or too slow when the tape cutter is in use.

Figure 5A:
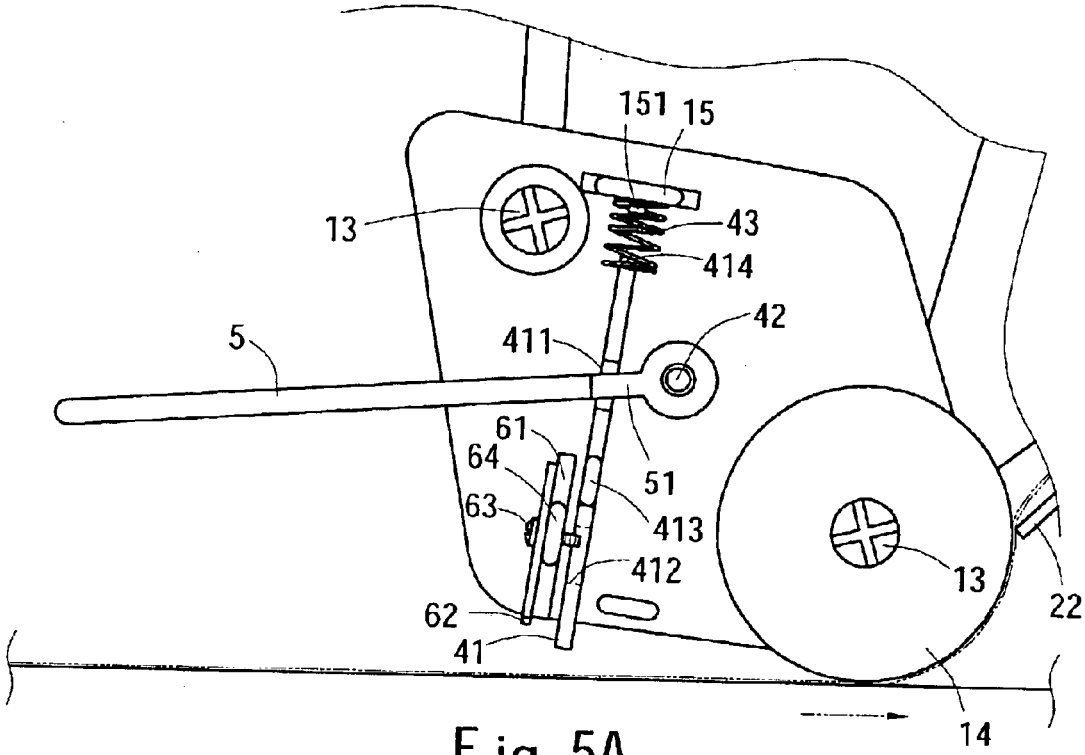
FIGS. 5A and 5B are schematic views of the present invention in operating conditions.
Figure 5B:
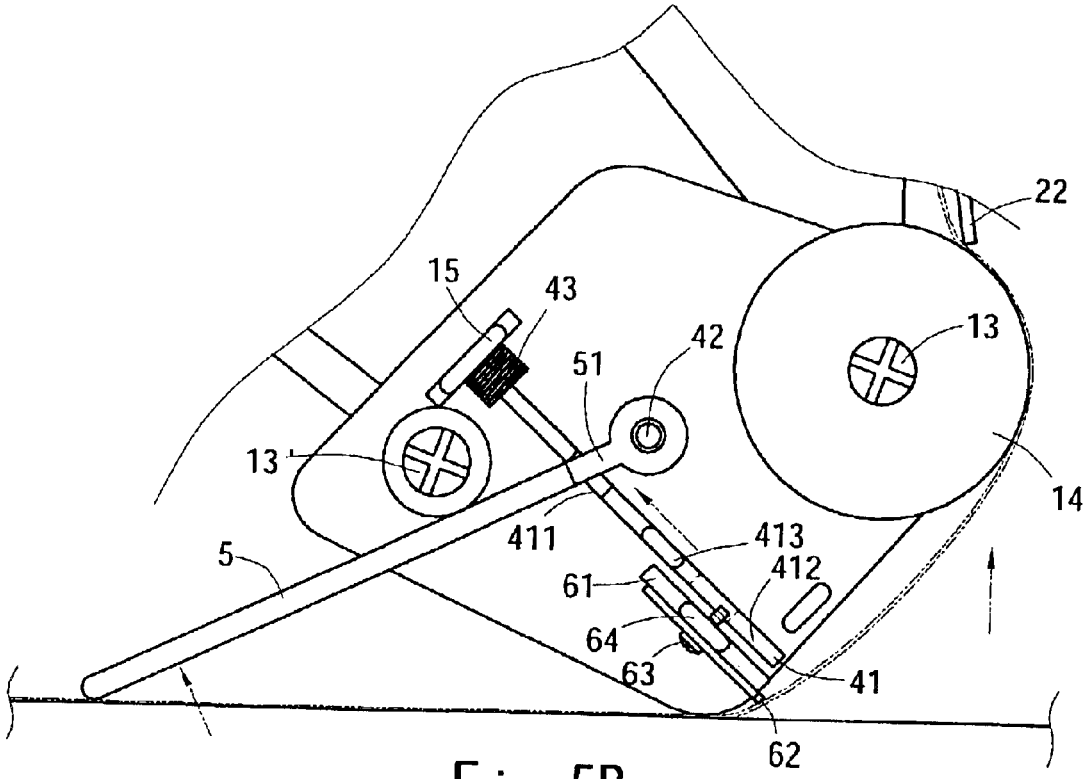

Referring to FIGS. 5A and 5B, when in use and users want to dispense the adhesive tape, users may pull out a small section of the tape from the tape roll on the shaft 31 and thread the tape through the gap between the grid gate 22 and the roller 14. The direction of the tape may be altered in parallel with a target object for bonding the tape. Stick the small section of the adhesive tape to the target object, exert a force on the handle 21 to move the tape cutter and the roller 14. The wiper 5 may be used to brush the tape already bonded to the target object to smooth the surface of the tape without creating air bubbles or wrinkles. Once the sealing task is completed, users may depress the tape, the wiper 5 will be pushed towards the fastener 13'. Meanwhile, the pivotal section 51 of the wiper 5 runs through the first operation zone 411 of the protective plate 41 to move the exposed portion of the protective plate 41 into the tape cutter so that the cutting blade 62 is extended outside the protective plate 41 to sever the tape.

When the tape cutter is not in use, the elastic element 43 moves the protective plate 41 outside the tape cutter. The guiding section 413 of the protective plate 41 is moved in the operating slot 11 of the control mechanism 1 to channel the moving direction of the protective plate 41. When the guiding section 413 presses other end of the operating slot 11, the protective plate 41 is extended over the cutting blade 62 outside the tape cutter to avoid hurting users.

What is claimed is:

1. An adhesive tape cutter, comprising:

a control mechanism;

an operation mechanism located on the control mechanism; and a dispensing mechanism connecting to the control mechanism and located above the operation mechanism;

wherein the control mechanism includes:

a protective mechanism having a protective plate which has a first operation zone and two guiding sections located on two sides opposing each other, an axle located below the protective plate and an elastic element coupling with one end of the protective plate, each of the guiding sections being movable in an operating slot formed on the control mechanism, the elastic element having other end coupling with a back panel of the control mechanism;

a wiper having a pivotal section pivotally engaged with the axle and run through the first operation zone; and a cutting mechanism located above the protective plate having a panel and a cutting blade located on the panel, the panel having two lugs extending from two sides thereof to run through two apertures formed on the control mechanism; wherein the protective mechanism is extended over the cutting blade outside the tape cutter when the adhesive tape cutter is not in use to avoid hurting users.

2. The adhesive tape cutter of claim 1, wherein the elastic element is a spring which has one end coupling with the lug of the protective plate and other end coupling with a stub of the back panel.

3. The adhesive tape cutter of claim 1, wherein the cutting blade is fastened to the panel through a fastener which is extended through the panel and runs through a second operation zone.

* * * * *